US007528779B2

(12) United States Patent
Stutzke

(10) Patent No.: US 7,528,779 B2
(45) Date of Patent: May 5, 2009

(54) LOW PROFILE PARTIALLY LOADED PATCH ANTENNA

(75) Inventor: Nathan Stutzke, Louisville, CO (US)

(73) Assignee: Laird Technologies, Inc., Lincoln, NE (US)

( * ) Notice: Subject to any disclaimer, the term of this patent is extended or adjusted under 35 U.S.C. 154(b) by 0 days.

(21) Appl. No.: 11/552,868

(22) Filed: Oct. 25, 2006

(65) Prior Publication Data

US 2008/0100511 A1 May 1, 2008

(51) Int. Cl.
*H01Q 1/38* (2006.01)

(52) U.S. Cl. ..... 343/700 MS

(58) Field of Classification Search ..... 343/700 MS, 343/702

See application file for complete search history.

(56) References Cited

U.S. PATENT DOCUMENTS 4,021,810 A 5/1977 Urpo et al.
6,218,992 B1 4/2001 Sadler et al.
6,278,344 B1 * 8/2001 Kurisu et al. ..... 333/219.1
6,337,667 B1 1/2002 Ayala et al.
6,414,637 B2 * 7/2002 Keilen ..... 343/700 MS
6,507,316 B2 * 1/2003 Mendelsohn et al. .. 343/700 MS
6,642,893 B1 11/2003 Hebron et al.
6,674,405 B2 1/2004 Wang
6,727,854 B2 4/2004 Fang et al.
6,738,023 B2 5/2004 Scott et al.
6,812,892 B2 11/2004 Tai et al.
6,870,506 B2 3/2005 Chen et al.
6,911,945 B2 * 6/2005 Korva ..... 343/702
7,352,326 B2 * 4/2008 Korva et al. ..... 343/700 MS
2002/0047802 A1 * 4/2002 Voipio ..... 343/700 MS
2004/0196190 A1 * 10/2004 Mendolia et al. ..... 343/700 MS
2005/0116875 A1 * 6/2005 Yuanzhu et al. ..... 343/846
2005/0259031 A1 11/2005 Sanz et al.
2005/0270243 A1 12/2005 Caimi et al.
2006/0071857 A1 4/2006 Pelzer
2007/0052588 A1 * 3/2007 Liu et al. ..... 343/700 MS

FOREIGN PATENT DOCUMENTS

EP 1 617 512 A1 1/2006

* cited by examiner

*Primary Examiner*—Tan Ho
(74) *Attorney, Agent, or Firm*—Harness, Dickey & Pierce, P.L.C.

(57) ABSTRACT

A low profile antenna comprises a radiating element arranged over a ground plane. The radiating element has a plurality of radiating edges. Dielectric elements are coupled to the radiating edges.

19 Claims, 2 Drawing Sheets

LOW PROFILE PARTIALLY LOADED PATCH ANTENNA

CLAIM OF PRIORITY UNDER 35 U.S.C. §119

None.

CLAIM OF PRIORITY UNDER 35 U.S.C. §120

None.

REFERENCE TO CO-PENDING APPLICATIONS FOR PATENT

None.

BACKGROUND

1. Field

The technology of the present application relates to patch antennas, and more specifically to low profile partially loaded patch antenna.

2. Background

Satellite communications currently requires a radio frequency antenna that operates over one or more frequencies. Many conventional antennas can be used in the appropriate frequencies for satellite communications, such as for example, conventional planar inverted-F antennas, patch antennas, microstrip antennas, etc. However, as satellite usage has increased, companies have begun demanding better performance from antennas while at the same timerestricting the antenna profile.

Several conventional antennas such as the monopole, dipole, inverted-F, and other could be used to meet the performance requirements for satellite communications.

However, these designs are often taller than the desired profile and taking meansures to lower the height results in lowering the efficiency. A conventional patch antenna has a relatively low profile and is a good candidate, but its footprint at frequencies in the appropriate ranges (for example, 100-200 MHz) is very large, often larger than the space allowed or available. Its possible to reduce the profile by providing a high dielectric constant between the ground plane and the patch. This avenue has several drawbacks including the fact that the large dielectric material is heavy and costly to both manufacture and ship.

Thus, against this background, it would be desirable to provide a low profile antenna.

SUMMARY

To attain the advantages of and in accordance with the purpose of the present invention, a low profile antenna is provided. The low profile antenna comprises a radiating element arranged over a ground plane. The radiating element has a feed connection that can be either directly or indirectly coupled. The radiating element has a plurality of radiating edges. The radiating edges are selectively loaded with a dielectric, wherein the profile of the antenna fits in the available space.

The foregoing and other features, utilities and advantages of the invention will be apparent from the following more particular description of a preferred embodiment of the invention as illustrated in the accompanying drawings

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

The word "exemplary" is used herein to mean "serving as an example, instance, or illustration." Any embodiment described herein should be construed as "exemplary," unless explicitly stated otherwise, whether it is specifically referred to as exemplary or not, and is not necessarily to be construed as preferred or advantageous over other embodiments.

Figure 1:
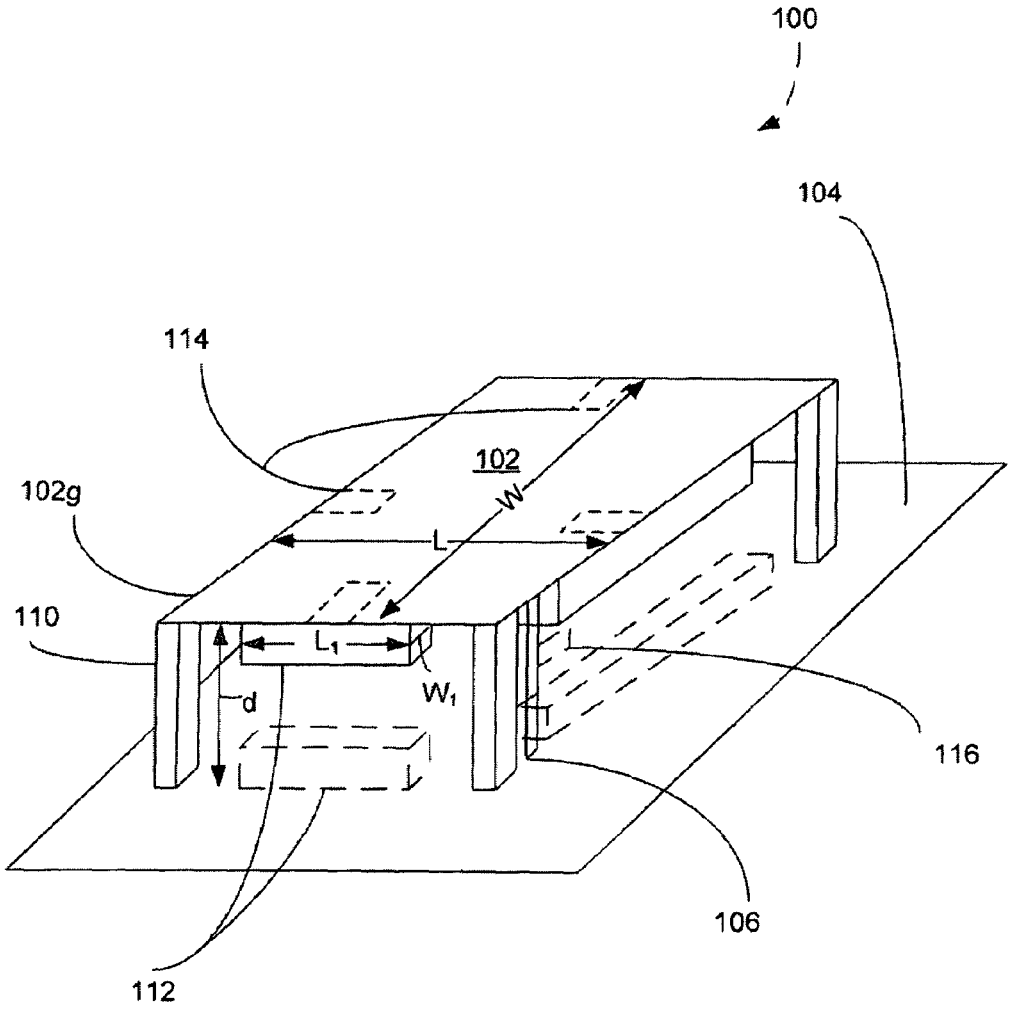
FIG. 1 is a functional block diagram of an antenna exemplary of an embodiment of the technology described by the present application.
Figure 2:
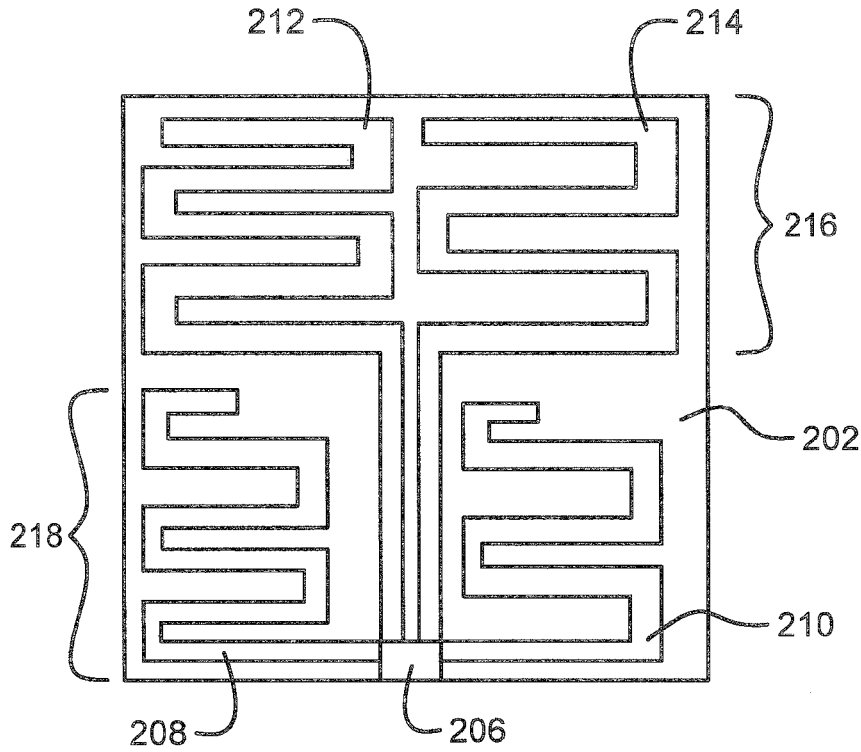
FIG. 2 is a top plane view of one potential radiating element associated with FIG. 1.

The technology of the present application will know be described with specific reference to FIGS. 1 and 2. While FIGS. 1 and 2 specifically relate to a low profile patch antenna useful for current satellite communication frequencies, one of ordinary skill in the art will recognize on reading the disclosure that satellite communication is simply one exemplary embodiment of the technology. The present invention would be useful in other radio frequency communication devices as well. Moreover, while described in the context of a patch antenna, other conventional antennas could use the technology of the present invention as well.

Referring first to FIG. 1, an antenna 100 is provided. Antenna 100 includes a radiating element 102 forming a generally planar surface over a ground plane 104.

Radiating element 102 has a ground facing side 102*g*. A distance d separates the ground plane from the radiating element. Antenna 100 also comprises a feed connection 106. Radiating element 102 may be supported over ground plane 104 using any number of conventional techniques, but as shown four corner supports 110 are shown. In practice, antenna 100 would likely be provided in a housing (not specifically shown) and the supports could be provided as part of the molded housing. Radiating element 102 may be supported by dielectric elements 112 instead of either the housing or support posts 110 as shown.

Extending downward from the radiating edges of antenna 100 are dielectrics elements 112. Dielectrics elements 112 are coupled to radiating element 102 on the ground facing side 102g and extend to or toward the ground plane 104 Dielectric elements 112 must be closely coupled to radiating element 102 as well as ground plane 104 to achieve the desired reduction of resonant frequency for satellite operating ranges.

As shown, radiating element 102 has a length L and a width W. Dielectric elements 112 have a length $L_1$ and $W_1$ less than length L and width W such that the volume occupied by dielectric elements 112 is substantially less than the volume defined by L×W×d.

In order to provide a multi-band radio frequency antenna, radiating element 102 is sized such that L≠W. Orthogonal patch modes are driven and antenna 100 is resonant at two distinct frequencies determined by L and W. Slots 114 are optional and shown in phantom. Varying the length of slots 114 alters the effective dimensions of the patch edges and allows fine tuning of the resonant frequencies. The lengths of slots 114 have much less impact on the resonant frequencies than do the dimensions L and W of radiating element 102. While slots 114 are shown as essentially straight slots, slots 114 may be any number of shapes and sizes depending on operational requirements of the antenna 100. For example, slots 114 may be any straight, L-shaped, meandering, or the like. Also, slots 114 do not need to be identical on each edge. Varying the feed position relative to the edges of radiating element 102 allow the two resonances to be matched. Alternatively, an additional matching network 116 could be provided.

While shown as rectangular, radiating element 102 may comprise different shapes, such as square, triangular, octagonal, etc. Generally speaking, the number of dielectric elements will correspond to the number of radiating edges associated with radiating element 102. One exemplary embodiment of the technology comprises an antenna in a footprint of approximately 275 mm by 325 mm having operating frequencies between 137-138 MHz and 148-150 MHz. Using a radiating element of approximately 200 mm by 250 mm with a dielectric elements having an $\in_r$ equal to approximately 100 and dimensions of approximately 100 mm by 22 mm by 15 mm, it was found the overall height of antenna 100 was no more than 23 mm including a housing component. Thus, as can be seen by this overall profile of this exemplary antenna is relatively low. In this exemplary embodiment the dielectric elements are bonded to radiating element 102 and ground plane 104 using conductive tape. Varying the conductivity of the tape changes the Q-factor (and therefore bandwith) of the antenna. Wider bandwidth can be provided by lowering the conductivity of the tape. However, wider bandwidth comes at the expense of lower efficiency. Varying the conductivity of the tape also effects the impedance seen at the edges of radiating element 102 and ultimately the point at which the antenna feed should be placed for best matching.

Referring now to FIG. 2, patch radiating element may be simulated with meanderline elements 208, 210, 212, 216 formed into low and high frequency portions 216 and 218 feed by feed point 206. Otherwise, FIG. 2 operates substantially the same as described above in reference to FIG. 1.

The previous description of the disclosed embodiment is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A low profile antenna, comprising:

a ground plane;

a radiating element, the radiating element comprising a plurality of radiating edges and a ground facing side, the radiating element separated from the ground plane by a distance d, the distance d such that a volume exists between the radiating element and the ground plane;

a plurality of dielectric elements corresponding to the plurality of radiating edges, wherein the plurality of dielectric elements equals the plurality of radiating edges, where each of the plurality of dielectric elements is only coupled to a corresponding one of the plurality of radiating edges on the ground facing side and extending toward the ground plane; and a power feed connected to the radiating element, wherein a volume occupied by the dielectric elements is substantially less than the volume that exists between the radiating element and the ground plane.

2. The antenna of claim 1, wherein the radiating element has a length L and a width W; and the at least one dielectric element has a length $L_1$ and a width $W_1$ less than L and W.

3. The antenna of claim 2, wherein L is not equal to W.

4. The antenna of claim 1, wherein the antenna operates at multiple frequencies.

5. The antenna of claim 4, wherein the radiating element comprises at least one slot.

6. The antenna of claim 1, wherein the dielectric elements are coupled to the radiating element using conductive tape.

7. The antenna of claim 1, further comprising an impedance matching network.

8. A low profile antenna, comprising:

a ground plane;

a patch radiating element, the patch radiating element comprising a plurality of radiating edges and a ground facing side, the radiating element having a first length and a first width separated from the ground plane by a distance d and defining a volume between the radiating element and the ground plane;

a plurality of dielectric elements corresponding to the plurality of radiating edges, wherein the plurality of dielectric elements equals the plurality of radiating edges, such that one dielectric element exists and is aligned with only one of the plurality of radiating edges and is coupled to only one of the ground plane or the aligned one of the plurality of radiating edges of the patch radiating element, the plurality of dielectric elements having a second length less than the first length and a second width less than the first width; and a power feed connected to the radiating element, wherein the plurality of dielectric elements occupy a space substantially less than the volume between the radiating elements and the ground plane.

9. The low profile antenna of claim 8, wherein the patch radiating element comprises a plurality of meanderline elements.

10. The low profile antenna of claim 8, wherein the patch radiating element comprises a plurality of slots.

11. The low profile antenna of claim 8, wherein the patch radiating element comprises a length L and a width W.

12. The low profile antenna of claim 8, wherein the plurality of dielectric elements comprise a length $L_1$ and a width $W_1$ less than the length L and the width W.

13. The low profile antenna of claim 8, wherein the length L is not equal to the width W.

14. The low profile antenna of claim 8, further comprising an impedance matching network.

15. The low profile antenna of claim 8, wherein the patch radiating element resonates at multiple frequencies.

16. A low profile antenna, comprising:

a ground plane;

a radiating element, the radiating element comprising a plurality of radiating edges and a ground facing side, the radiating element separated from the ground plane by a distance d, the radiating element having a first length and a first width;

a plurality of dielectric elements, wherein the plurality of dielectric elements equals the plurality of radiating edges, where each of the plurality of dielectric elements are coupled to only one of the plurality of radiating edges on the ground facing side and extending toward the ground plane, the plurality of dielectric elements having a second length less than the first length and a second width less than the first width; and a power feed connected to the radiating element, wherein the surface area of the radiating element is greater than the surface area of the plurality of dielectric elements.

17. The low profile antenna of claim 16 wherein the plurality of dielectric elements occupy a space significantly less than the volume defined by L×W×d.

18. The low profile antenna of claim 16 wherein the radiating element comprises at least one slot.

19. The low profile antenna of claim 16 wherein the power feed is directly connected to the radiating element.

* * * * *